US005123821A

United States Patent [19]

Willibald et al.

[11] Patent Number: 5,123,821

[45] Date of Patent: Jun. 23, 1992

[54] SCREW SPINDLE PUMP WITH A REDUCED PULSATION EFFECT

[75] Inventors: Klaus Willibald, Bodman-Ludwigshafen; Rolf Quast, Singen, both of Fed. Rep. of Germany

[73] Assignee: Allweiler AG, Radolfzell, Fed. Rep. of Germany

[21] Appl. No.: 617,678

[22] Filed: Nov. 26, 1990

[30] Foreign Application Priority Data

Mar. 8, 1990 [DE] Fed. Rep. of Germany ..... 4007273

[51] Int. Cl.[5] ..... F04C 2/16

[52] U.S. Cl. ..... 418/197; 418/201.3

[58] Field of Search ..... 418/191, 194, 197, 201.3

[56] References Cited

U.S. PATENT DOCUMENTS

| | | | |
|---|---|---|---|
| 2,652,192 | 9/1953 | Chilton | 418/197 |
| 2,952,216 | 9/1960 | Wildhaber | 418/197 |
| 3,103,894 | 9/1963 | Sennet | 418/197 |
| 3,814,557 | 6/1974 | Volz | 418/197 |
| 4,018,549 | 4/1977 | Segerström | 418/197 |
| 4,522,576 | 6/1985 | Carré et al. | 418/201.3 |

FOREIGN PATENT DOCUMENTS

| | | | |
|---|---|---|---|
| 0209984 | 1/1987 | European Pat. Off. . | |
| 1403882 | 12/1968 | Fed. Rep. of Germany . | |
| 3815158 | 11/1989 | Fed. Rep. of Germany . | |
| 1243471 | 9/1960 | France | 418/197 |
| 52-38615 | 3/1977 | Japan | 418/201.3 |

*Primary Examiner*—Richard A. Bertsch
*Assistant Examiner*—David L. Cavanaugh
*Attorney, Agent, or Firm*—Bachman & LaPointe

[57] ABSTRACT

In a displacement pump having at least one screw spindle which is mounted in an opening in a housing surrounding same between a suction chamber and a pressure chamber, the profile termination of the spindle, at the pressure end, is turned off in a conical configuration at the outside diameter (d), and the angle of inclination (w) of the conical surface (43) is below 10°. In addition the spindle is to be provided at its end on the suction side with a conical surface with an angle of inclination ($w_1$) which is below 5°, preferably below 3°.

11 Claims, 2 Drawing Sheets

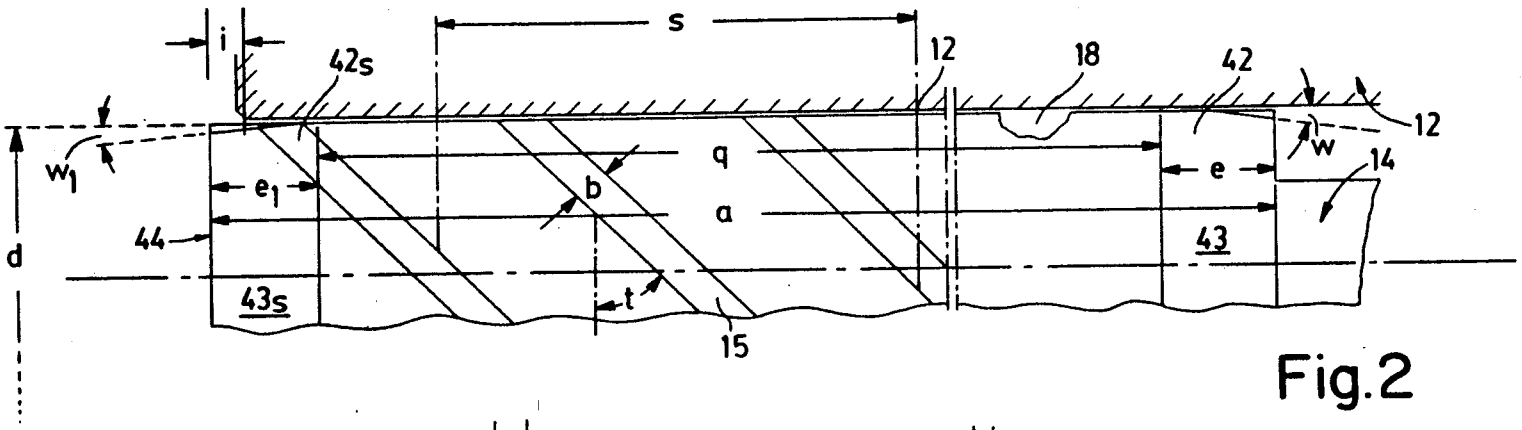
Fig.2
Fig.3
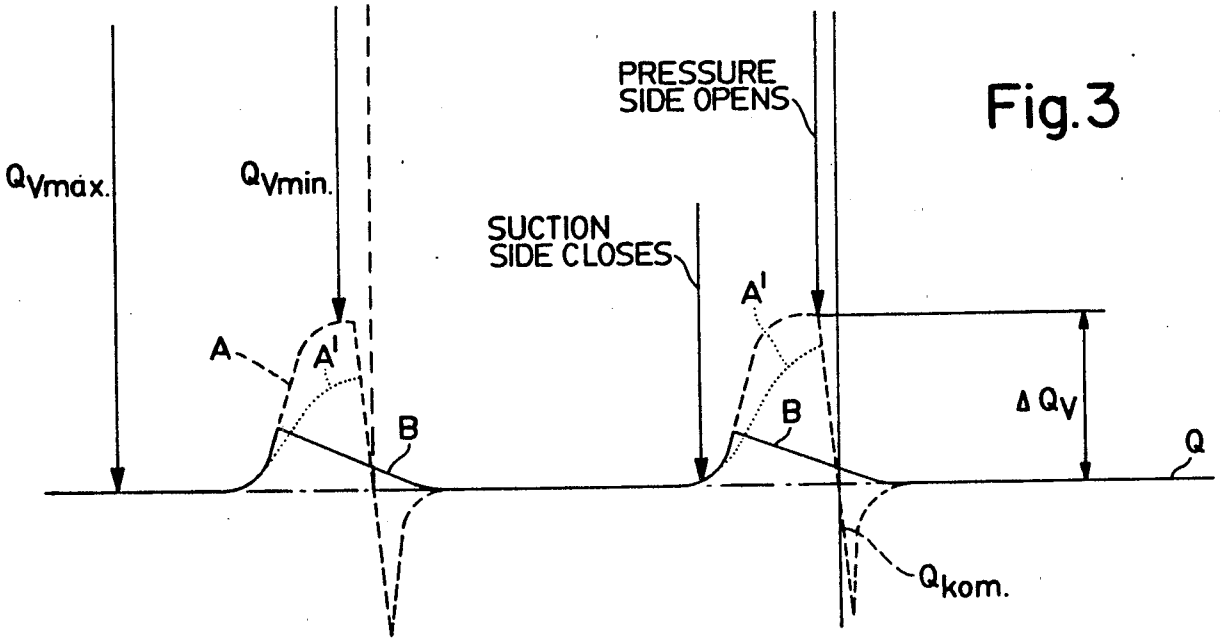

SCREW SPINDLE PUMP WITH A REDUCED PULSATION EFFECT

DESCRIPTION

The invention relates to a displacement pump, in particular a screw spindle pump, as described for example in German laid-open application (DE-OS) No 38 15 158.

In the method disclosed therein for reducing pressure pulsation, the typical pressure pulsation has superimposed thereon a forced inverse pressure pulsation which can be produced by periodically bleeding off a part of the delivery flow on the pressure side of the conveyor screws. That method is made possible by an aperture member on the pressure side, which involves a discharge flow to the suction side, being periodically covered over by means of a closure member in dependence on the rotational position of the drive spindle. That publication also describes the point that incorporated into the receiving bores at the pressure end of the housing are taper bevels which taper towards the suction chamber.

With knowledge of that state of the art, the inventor set himself the aim of further improving a displacement pump of the kind described above, without the addition of further machine components.

SUMMARY OF THE INVENTION

That object is attained by a displacement pump, in particular a screw spindle pump, comprising at least one screw spindle which is mounted in an opening in a housing surrounding same between a suction chamber and a pressure chamber, wherein the profile termination of the spindle at the pressure end, is turned off in a conical configuration at the outside diameter (d) and the angle of inclination (w) of the conical surface is below 10°. An aspect of particular significance in regard to the reduction of a pulsation effect is an extremely shallow conical surface with an angle of inclination of below 10°, preferably even below 3°.

That bevel at the pressure side provides that the chamber at the pressure side is gradually opened in a defined manner at the appropriate time; in that way the rise in pressure or volume flow which occurs due to closure of the suction side can be compensated for the major part thereof. The output pulsation is markedly reduced.

In accordance with a further feature of the invention the profile termination at the suction end may also be provided with a shallow conical surface of that kind, in which respect however the axial length of the last-mentioned conical surface is to be less than the axial length of the conical surface at the pressure end.

That provides that the pulsation effect is reduced by specific matching of the operative length of the system and the conical configuration at the pressure end and possibly also at the suction end.

In accordance with another independent feature the tooth thickness of the drive spindle is to be reduced towards the profile termination or the tooth gap of the idler spindle, which corresponds to said tooth thickness, is to be increased in width in the same direction.

BRIEF DESCRIPTION OF THE DRAWINGS

Further advantages, features and details of the invention will be apparent from the following description of preferred embodiments and with reference to the drawings in which:

FIG. 2 is a view on an enlarged scale and in section through part of the screw spindle pump, FIG. 3 is a diagram illustrating the pressure pulsation or volume flow pulsation of the screw spindle pump.

DETAILED DESCRIPTION

Figure 4:
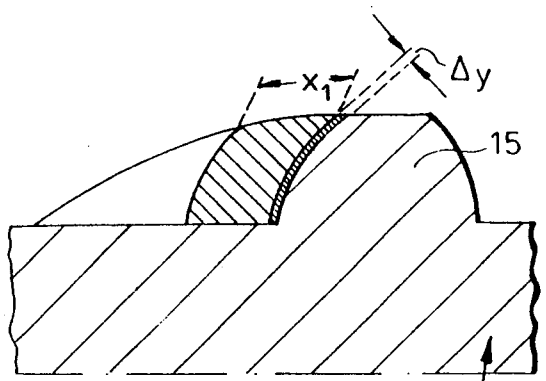
FIG. 4 is a diagrammatic view in section relating to the tooth thickness dimensioning.
Figure 1:
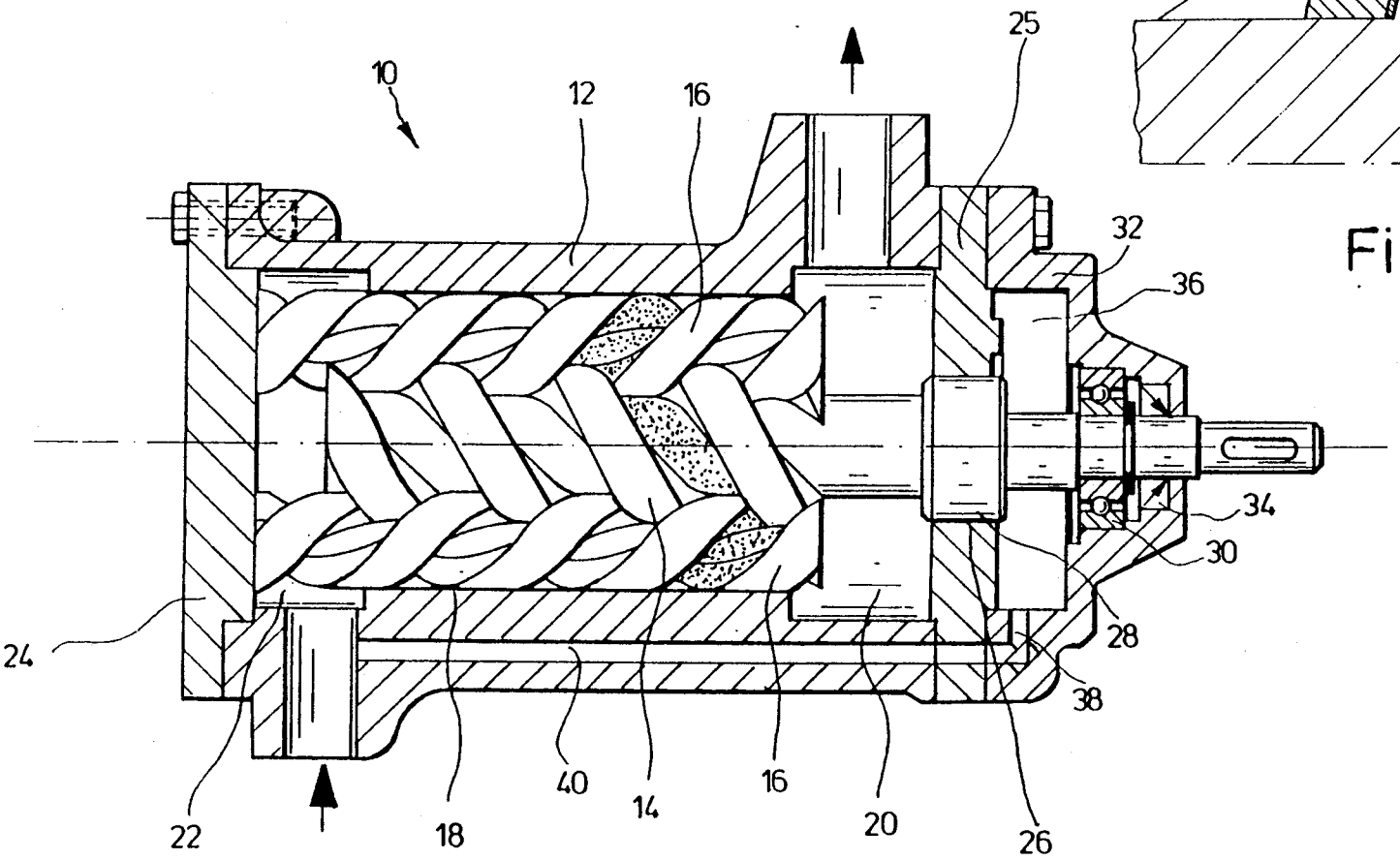
FIG. 1 is a view in longitudinal section through a screw spindle pump.

A screw spindle pump 10 comprises in a housing 12 a drive spindle 14 of an outside diameter d and two laterally disposed idler spindles 16. The spindles 14 and 16 are mounted in mutually overlapping receiving bores 18 in the housing 12.

The housing 12 is closed both at its pressure end and also at its suction end by respective pump end members 25 and 24 respectively, forming a pressure chamber 20 and a suction chamber 22. The drive spindle 14 which is passed through the pump end member 25 at the pressure end is provided in the region of a passage bore 26 with an axial thrust compensating piston 28, and is additionally supported by a bearing 30 in an end member attachment portion 32. A shaft seal 34 is also disposed in the latter.

The internal space 36 in the end member attachment portion 32 is relieved of the load of the delivery pressure; the liquid entering from the pressure chamber 20 is discharged by way of a relief passage 38 which communicates with the suction chamber 22 by way of a communicating bore 40 in the housing 12.

FIG. 2 makes it clear that the drive spindle 14, of the profile length, is turned off at its ends in a conical configuration, wherein the length of the cone portion 42 at the pressure end is identified by e, the length of the cone portion $42_s$ at the suction end, which projects with its end surface 44 by a distance i, is identified by $e_1$, the cylindrical length remaining on the drive spindle 14 between the conical surfaces 43 and $43_s$ is identified by q, the pitch angle of the screw flight 15, of which only part is shown in FIG. 2, on the drive spindle 14 or the idler spindle 16 is identified by t, and the pitch is indicated by s. The cone angle on the pressure side, as indicated at w, or the cone angle on the suction side, as indicated at $w_1$, is preferably 2°.

FIG. 3 shows in graph form the optimization in respect of length by virtue of a pre-compression effect according to the invention, with the letters used therein bearing the following meanings:

A: output pulsation;

B: pulsation when using the precompression effect;

ΔQv: wastage volume flow;

$Q_{kom}$: compression volume flow.

The matching in respect of length of the entire system is so selected that an increase in sealing lines is produced during a part of the delivery period, as indicated in FIG. 3; that means a rise from Qvmax to Qvmin. By specifically varying the sealing quality by way of the described cone configuration 42, 'hard' or violent opening, due to the spindle geometry, is avoided, in particular on the pressure side.

Starting from the initial pulsation effect therefore, the pulsation image is altered by the provision of the described conical surface 43 at the end of the spindle at the pressure end, and that results in a reduction of ΔQv and $Q_{kom}$. The increase in the length of the conical surface 43 which is inclined in terms of cross-section provides that on the one hand the pressure side opens earlier while on the other hand the cross-sections become continuously larger during the opening procedure. It may thus be sufficient to provide the pressure side with the conical configuration 42 and to leave the spindle end on the suction side cylindrical.

In regard to the three-spindle screw spindle pump 10 shown, the operational system may be described in the following terms:

On the basis of a given number of chambers n, which is a measurement of the pressure build-up internal to the pump, the ratio of length to pitch, that is to say a/s, represents an analog parameter in respect of the geometrical configuration; the greater that ratio is, the less is the increase in pressure per unit of length.

For applying the precompression process, the following requirements have to be met in regard to length matching:

$$a/s = 1 + (2 \cdot n - 1) \cdot X \quad \text{with } nEN_o, \text{ i.e. } 1, 2, \ldots$$

wherein x is a pre-factor with $0.15 < x < 0.4$, and n describes the number of chambers acting on average.

The pre-factor x is a measurement in respect of the pre-compression effect which moreover, in dependence on profile, only occurs for values above 0.1–0.15.

It should be noted that the information set out below relates to the particularly advantageous bevelling according to the invention of the drive spindle 14.

With a constant angle w ($0 < w < 3°$) the conical configuration 42 at the pressure end must be adapted to that dimension x, that is to say to the pre-compression effect achieved. Thus for example for an angle w of about 2°, the length e is so selected that in the normal situation $e \leqq x \cdot s$ applies; here for example with $x = 0.25$; $n = 3$; $s = 80$ mm, that is to say $a/s = 2.25$ and with a conical configuration 42 on the pressure side, of a length e of 20 mm, only very small residual pulsation occurs.

The conical configuration $\mathbf{42}_s$ at the suction end quite generally, permits adaptation of the closing characteristics, as indicated at A' in FIG. 2. The conical configuration $\mathbf{42}_s$ must be precisely matched to the conical configuration 42 at the pressure end, on the basis of a defined relationship a/s in respect of length. Thus for example the length $e_1$ of the conical configuration $\mathbf{42}_s$ is desirably to be less than the length e of the other conical configuration 42. Furthermore, with an unaltered dimension in respect of the spindle array 14, 16, the length e of the conical configuration 42 at the pressure end is overall to be made smaller.

Careful matching of the overall geometry results in an effective reduction in pulsation over a wide range of pressures of from 10 to 80 bars and in the viscosity range of from 20 to 200 $mm^3/s$.

At any event a clearly reduced pulsation effect is achieved without involving additional machine components.

In an alternate embodiment, the tooth thickness b of the screw flight 15 on the drive spindle 14 is reduced at its profile termination. The tooth gap on the idler spindle 16 may also be increased in width.

The structural alteration in the tooth thickness b or the tooth gaps towards the profile termination is to be such that the pre-opening action can occur sufficiently early; the length of the alteration $x_1$ as shown in FIG. 4 in regard to the profile involved must be marked in relation to the spindle pitch s. On the other hand the reduction in the tooth thickness or the increase in the width of the tooth gap must have a slight gradient $\Delta y$; $x_1$.

We claim:

1. A screw spindle pump which comprises: a housing having an opening therein; a suction chamber and a pressure chamber in the housing spaced from each other; a drive spindle and at least one idler spindle mounted in the opening in the housing between the suction chamber and the pressure chamber; wherein the profile termination of at least the drive spindle at the pressure end is turned off in a conical configuration at the outside diameter and the angle of inclination of the conical surface is below 10°.

2. A pump according to claim 1 including two laterally disposed idler spindles.

3. A pump according to claim 2 wherein the drive spindle and idler spindles are mounted in mutually overlapping relationship.

4. A pump according to claim 3 wherein the angle of inclination is less than 3°.

5. A pump according to claim 1 wherein at its suction end at least the drive spindle has a conical surface with an angle of inclination ($w_1$).

6. A pump according to claim 5 wherein the angle of inclination at the pressure and suction ends is below 5°.

7. A pump according to claim 1 wherein said drive and idler spindles include said angle of inclination.

8. A screw spindle pump according to claim 1 which including: a drive spindle having a tooth thickness and mounted in the opening in the housing between the suction and pressure chambers; wherein the tooth thickness of the drive spindle is reduced towards its profile termination.

9. A pump according to claim 8 including at least one idler spindle having a tooth gap and mounted in the opening in the housing, wherein the tooth gap of the idler spindle corresponds to the tooth thickness of the drive spindle and wherein said tooth gap is increased in width towards its profile termination.

10. A screw spindle pump which comprises: a housing having an opening therein; a suction chamber and a pressure chamber in the housing spaced from each other; a drive spindle mounted in the opening in the housing between the suction and the pressure chambers; wherein the profile termination of the drive spindle at the pressure and suction ends is turned off in a conical configuration at the outside diameter thereof and the angle of inclination of the conical surfaces is below 10°; and wherein the axial length of the conical surface at the pressure end is greater than the axial length of the conical surface at the suction end.

11. A pump according to claim 10 including at least one idler spindle mounted in the opening in the housing.

* * * * *

US005123821C1

(12) EX PARTE REEXAMINATION CERTIFICATE (8023rd)

United States Patent
Willibald et al.

(10) Number: US 5,123,821 C1
(45) Certificate Issued: Feb. 15, 2011

(54) SCREW SPINDLE PUMP WITH A REDUCED PULSATION EFFECT

(75) Inventors: Klaus Willibald, Bodman-Ludwigshafen (DE); Rolf Quast, Singen (DE)

(73) Assignee: Allweiler AG, Radolfzell (DE)

Reexamination Request:
No. 90/009,116, Apr. 18, 2008

Reexamination Certificate for:

| | |
|---|---|
| Patent No.: | **5,123,821** |
| Issued: | **Jun. 23, 1992** |
| Appl. No.: | **07/617,678** |
| Filed: | **Nov. 26, 1990** |

(30) Foreign Application Priority Data

Mar. 8, 1990 (DE) ..... 4007273

(51) Int. Cl.
*F04C 2/16* (2006.01)

(52) U.S. Cl. ..... 418/197; 418/201.3

(58) Field of Classification Search ..... None
See application file for complete search history.

(56) References Cited

U.S. PATENT DOCUMENTS

| | | | | | |
|---|---|---|---|---|---|
| 612,304 | A | * | 10/1898 | Blazer | 418/194 |
| 2,652,192 | A | * | 9/1953 | Chilton | 418/150 |
| 3,383,015 | A | * | 5/1968 | Miler | 222/1 |
| 3,574,488 | A | * | 4/1971 | Vanderstegen-Drake | 418/15 |
| 4,558,991 | A | * | 12/1985 | Barr | 417/199.1 |

FOREIGN PATENT DOCUMENTS

| | | | |
|---|---|---|---|
| GB | 431983 | * | 7/1935 |
| GB | 448235 | * | 6/1936 |
| JP | 44-25107 | * | 10/1969 |

* cited by examiner

*Primary Examiner*—Glenn K. Dawson

(57) ABSTRACT

In a displacement pump having at least one screw spindle which is mounted in an opening in a housing surrounding same between a suction chamber and a pressure chamber, the profile termination of the spindle, at the pressure end, is turned off in a conical configuration at the outside diameter (d), and the angle of inclination (w) of the conical surface (43) is below 10°. In addition the spindle is to be provided at its end on the suction side with a conical surface with an angle of inclination ($w_1$) which is below 5°, preferably below 3°.

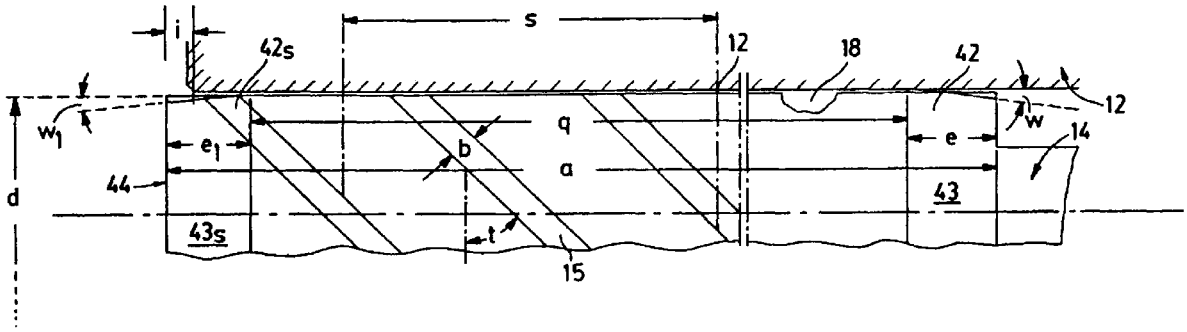

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-11 are cancelled.

* * * * *